US007485000B2

(12) United States Patent
Zeng

(10) Patent No.: US 7,485,000 B2
(45) Date of Patent: Feb. 3, 2009

(54) COAXIAL ELECTRICAL CONNECTOR

(75) Inventor: Qingyong Zeng, Jiangsu (CN)

(73) Assignee: Jiangsu Famfull Electronics Co., Ltd., Kunshan (CN)

( * ) Notice: Subject to any disclaimer, the term of this patent is extended or adjusted under 35 U.S.C. 154(b) by 0 days.

(21) Appl. No.: 11/874,822

(22) Filed: Oct. 18, 2007

(65) Prior Publication Data

US 2008/0096420 A1 Apr. 24, 2008

(30) Foreign Application Priority Data

Oct. 20, 2006 (CN) ..... 2006 2 0126938
Feb. 6, 2007 (CN) ..... 2007 2 0034267

(51) Int. Cl.
*H01R 9/05* (2006.01)

(52) U.S. Cl. ..... 439/582; 439/585

(58) Field of Classification Search ..... 439/394, 439/578, 582, 585, 610
See application file for complete search history.

(56) References Cited

U.S. PATENT DOCUMENTS 5,263,877 A * 11/1993 Mitani ..... 439/585
5,482,475 A * 1/1996 Kawaguchi ..... 439/394
5,772,470 A * 6/1998 Togashi ..... 439/582
6,206,727 B1 * 3/2001 Aoyama et al. ..... 439/585
6,447,335 B1 * 9/2002 Ko ..... 439/585
6,712,645 B1 * 3/2004 Chou ..... 439/582
7,025,598 B2 * 4/2006 Ikeda ..... 439/63
7,204,715 B2 * 4/2007 Kukita ..... 439/582
7,207,839 B1 * 4/2007 Shelly et al. ..... 439/585
7,351,067 B2 * 4/2008 Chen et al. ..... 439/63

* cited by examiner

*Primary Examiner*—Thanh-Tam T Le
(74) *Attorney, Agent, or Firm*—Vidas, Arrett & Steinkraus, P.A.

(57) ABSTRACT

In some embodiments, a coaxial electrical connector comprises a terminal member, an insulator, and a metallic shell. The terminal is located in the insulator, and the insulator is located in the metallic shell. The insulator has a foldaway extending member which has a groove. When the wire stock is inserted and placed in contact with the terminal, the extending member is bent toward the wire and the groove clips the wire tightly. Thus, the electrical connector ensures that the wire and the terminal are electrically connected.

19 Claims, 5 Drawing Sheets

COAXIAL ELECTRICAL CONNECTOR

CROSS-REFERENCE TO RELATED APPLICATIONS

This application claims the benefit of Chinese Patent Application No. CN200620126938.9, filed Oct. 20, 2006, and the benefit of Chinese Patent Application No. CN200720034267.8, filed Feb. 6, 2007, the entire disclosures of which are hereby incorporated herein by reference in their entireties.

FIELD OF THE INVENTION

The present invention relates to a coaxial electrical connector for connecting two members with wire stock, particularly for mobile-phone blue-tooth, wireless network, electronic gauge and so on.

BACKGROUND OF THE INVENTION

Normally, the transmitting circuit and the receiving circuit of wireless electrocircuit are connected with a coaxial cable and separated a certain distance away from each other in order to avoid mutual disturbance in the emitting signal and the receiving signal. According to the prior art, a coaxial electrical connector is composed of a terminal member with an oriented gap, an insulator with a through-hole and a gap, and a metallic shell with a cylinder member. There is a cover which covers the cylinder member on one end of the cylinder member, and a leading-in gap set on the other end of the cylinder. Here follows the method of the equipment being assembled: fix the terminal member in the through-hole in the insulator; then mount the insulator with the terminal member in the cylinder member of the metallic shell, making the leading-in gap of the metallic shell, the gap of the insulator and the oriented gap of the terminal member connected, and then make the wire stock go through the leading-in gap, the gap, and the guide gap sequentially; at last cover the cylinder with the cover of the metallic shell, bundling the wire with the bundle member of the metallic shell. The wire is cylindrical, so it is liable to loose between the terminal member and the cover, making the circuit shut down, so that the coaxial electrical connector of this kind is not of high reliability and can not meet the requirement of the market properly.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

Accordingly, to overcome the disadvantages of the prior art, the present invention is to provide a coaxial electrical connector which can fix the wire firmly.

The coaxial electrical connector provided by this invention comprises, a terminal member having a oriented gap for inserting wire stock, an insulator having a through-hole for mounting the said terminal member and a gap inter-connected with the said oriented gap of the terminal member, a metallic shell having a hollow cylinder member having a leading-in gap which is inter-connected with the gap of the insulator and connected with a rear-end of a cover which can be bended toward the cylinder member for mounting the insulator. The said insulator is connected with one end of a foldable extending member having a groove which is on the same side of the extending member with the through-hole on the other end to clamp the wire stock.

Furthermore, a bulge is set on the extending member on the opposite side to the said groove, which is contacted tightly to the cover (32), to press the wire stock tightly on the terminal member.

In a preferred embodiment, the said terminal member has at least one protrusion and the insulator has concaves matching to the at least one protrusion. Via the at least one protrusion and responding concaves, the terminal member can stably lie on the said insulator.

The said oriented gap in the terminal member is in U-shape, to avoid the wire stock gliding after the wire stock is inserted into the oriented gap.

The said cylinder member has convex-hulls and the said insulator has canals corresponding to the convex-hulls. Owning to the convex-hulls and canals, the said insulator can stably lie in the said metallic shell.

The front-end of the said cover extends forward, forming a bundle member comprising a first chip and at least one second chip which has more than one boss at the inner side for gripping the wire stock closely.

On each side of the said cover an alar part is arranged to clasp the cylinder member.

The relative side of the said leading-in gap on the metallic shell extends outwards, and then bends inwards, forming a hook-shaped clamp.

Compared with the related art, the present invention has advantage as follows: since there is a bendable extending member with a groove on one end in the insulator, when the wire stock is fixed on the terminal member through the gap, bending the extending member will jam the wire in the groove, making the wire and terminal contact with each other closely, so it is sure that the circuit wouldn't be shut down under normal circumstance, to meet the requirement of the market.

These and other embodiments which characterize the invention are pointed out with particularity in the claims annexed hereto and forming a part hereof However, for a better understanding of the invention, its advantages and objectives obtained by its use, reference can be made to the drawings which form a further part hereof and the accompanying descriptive matter, in which there are illustrated and described various embodiments of the invention.

DESCRIPTION OF THE ATTACHED DRAWINGS

Figure 1:
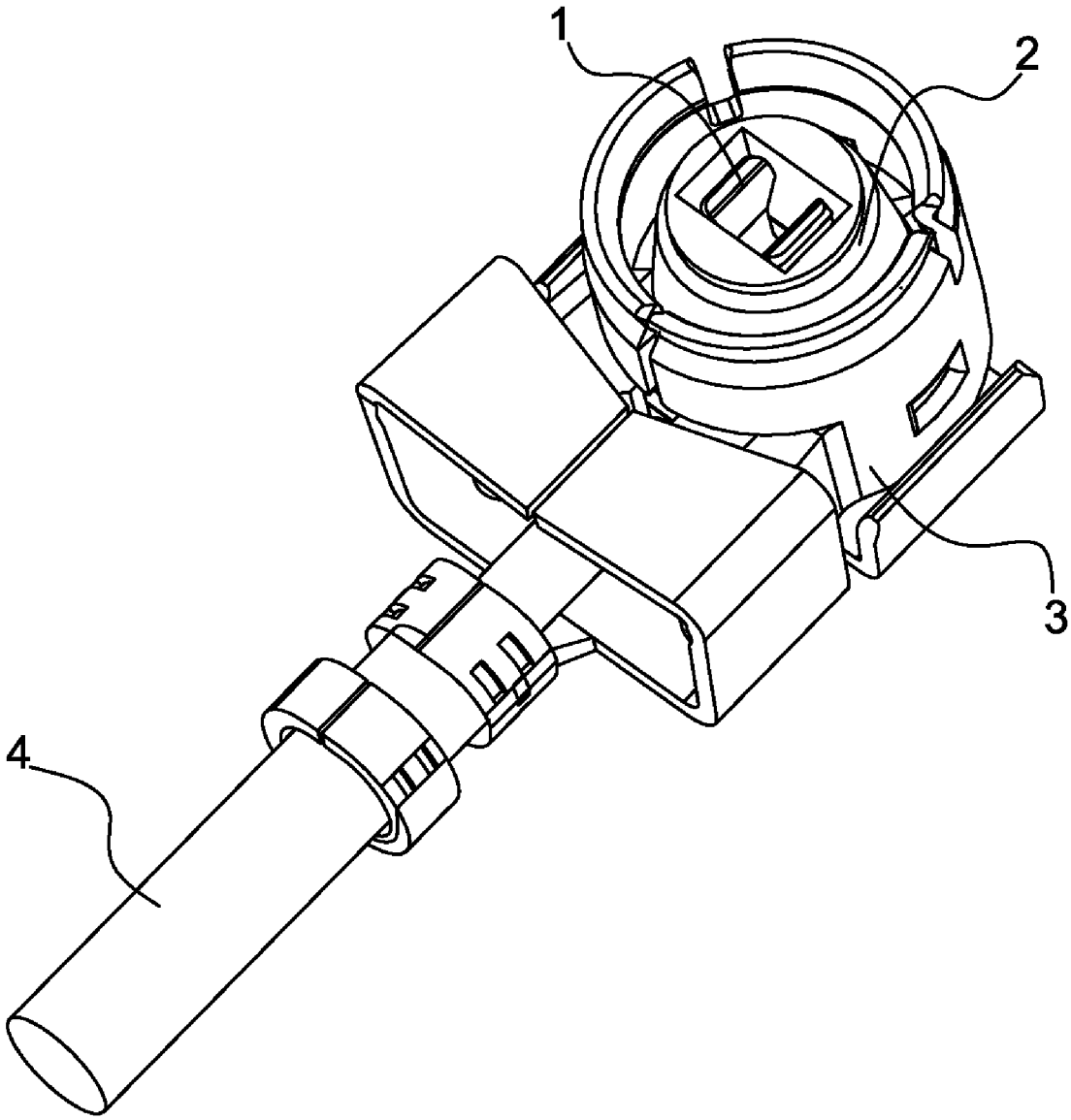
FIG. 1 is the perspective view of the electrical connector according to the present invention.

Wherein, 1, terminal member; 11, oriented-gap; 12, protrusion; 13, contact area; 14, joint area;

2, insulator; 21, through-hole; 22, gap; 23, extending member; 231, groove; 232, bulge; 24, concave; 25, canal;

3, metallic shell; 31, cylinder member; 311, alar part; 32, cover; 33, bundle member; 331, first chip; 332, second chip; 3321, boss; 34, leading-in gap; 341, hook-shaped clamp; 35, convex-hull; and 4, wire stock are lined out.

DETAILED DESCRIPTION OF PREFERRED EMBODIMENT

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

As shown in FIG. 1, a coaxial electrical connector according to the present invention includes a metallic shell 3, an insulator member 2 which is set in the metallic shell 3, and a terminal member 1 which is mounted in the insulator 2. When it needs to be used, wire stock can be inserted and placed in contact with the terminal member 1. Here follows the detailed description of the structure and connecting method of every component.

Figure 2:
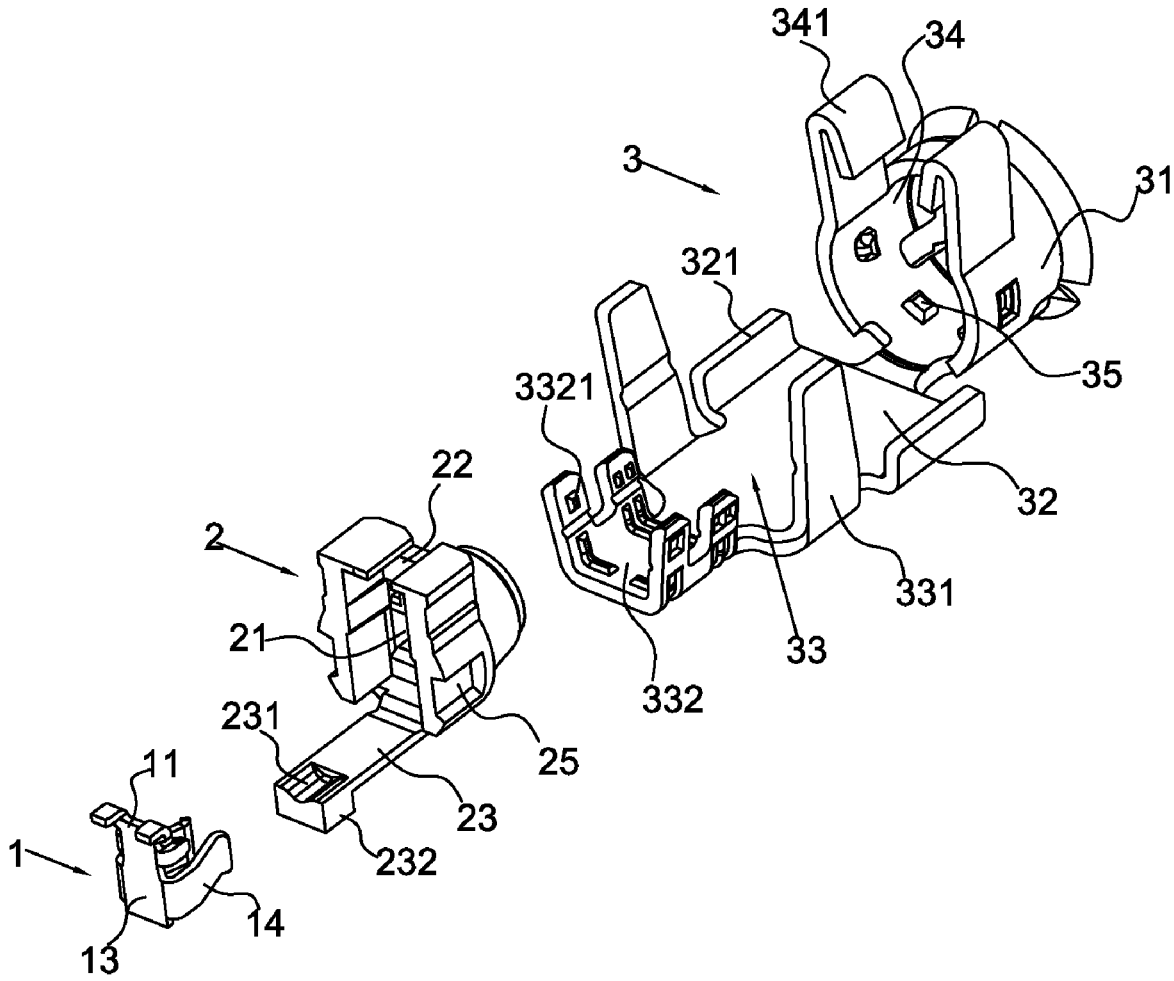
FIG. 2 is the exploded view of the electrical connector according to the present invention.
Figure 5:
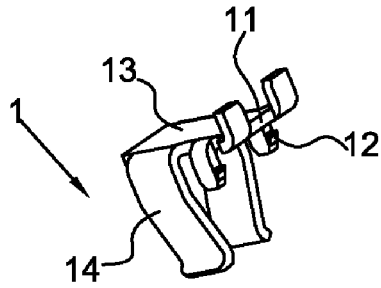
FIG. 5 is the enlarged perspective view of the terminal member according to the present invention.

The terminal member 1 as shown in FIG. 2 and FIG. 5 has a plane contact area 13, and a bugle shaped joint area 14 extending downwards from the contact area 13. There are two separated wings extending upwards on the other side of the contact area 13, forming a U-shaped oriented gap 11 with the contact area 13. The U-shaped oriented gap 11 can act as guidance during working, making sure the tangency of the wire stock and the contact area 13, the wire stock is also rigidly fixed.

In some embodiments, the terminal member 1 includes some protrusions 12, which are used to align the insulator 2 with the terminal member 1.

Figure 3:
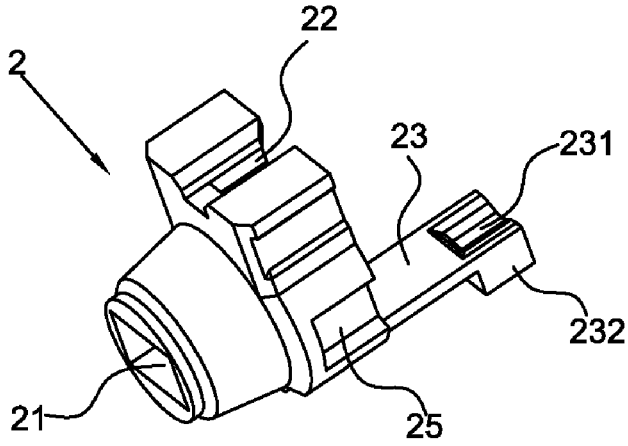
FIG. 3 is the enlarged perspective view of the insulator according to the present invention.
Figure 4:
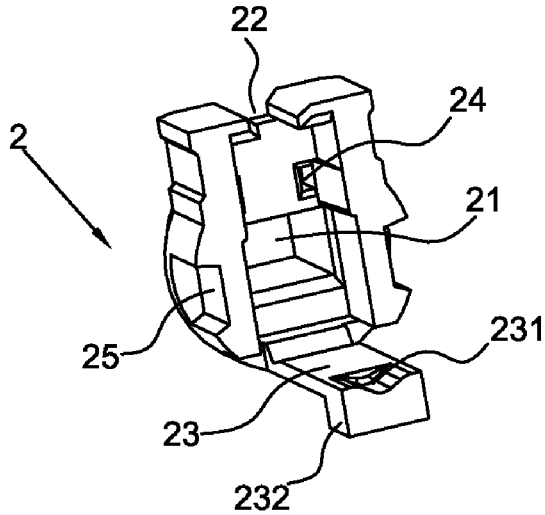
FIG. 4 is another enlarged perspective view of the insulator according to the present invention.

As shown in FIG. 2 to FIG. 4, an insulator 2 on which a through-hole 21 and a gap 22 is set, is made of an insulating material such as plastic. The insulator 2 comprises a positionable/bendable extending member or arm 23. On the same side with the through-hole 21, a groove 231 is set on one end of the bendable extending member 23, on the other end of which is connected with the insulator 2. There is a bulge 232 which will cooperate with the groove 231 to clamp the wire closely on the contrary/opposite side of groove 231 in the extending member 23. The bulge 232 can be positioned to contact the shell 3.

Some concaves or recesses 24 are set in the interior of the insulator 2 corresponding to the protrusions 12 of the terminal member 1, to mount the terminal member 1 in the insulator 2.

There are several canals or channels 25 opened in the exterior of the insulator 2.

As shown in FIG. 2, the metallic shell 3 is made of copper optimally. There is a hollow cylinder member 31 in the metallic shell 3. On one end of the cylinder member 31 there is a cover 32 which covers the cylinder member 3 1. Two alar or wing-like parts 321, extending upwards, are set on the two sides of the cover 32 to lock/grasp the cylinder member 31.

The front-end of the cover 32 extends forward, forming a bundle member 33, which can be used to pack the wire stock, comprising the first tab or chip 331 and several second tabs or chips 332 in front of the first chip 33 1. There are many bosses 3321 for gripping the wire stock in the inner side of each second chip 332, so the wire stock couldn't be pulled out easily. The tabs 331, 332 and bosses 3321 can be arranged to grasp the wire stock 4.

There are many convex-hulls or protrusions 35 matching the said channels 25 in the interior of the cylinder member 31. Each protrusion 35 can be oriented in a channel 25 of the insulator 2.

There is a leading-in gap 34 on one end of the cylinder member 31. The two sides of the leading-in gap 34 in the metallic shell 3 extend outwards, and then bends inwards, forming a hook-shaped clamp 341 that is oriented about the leading-in gap 34.

Figure 6:
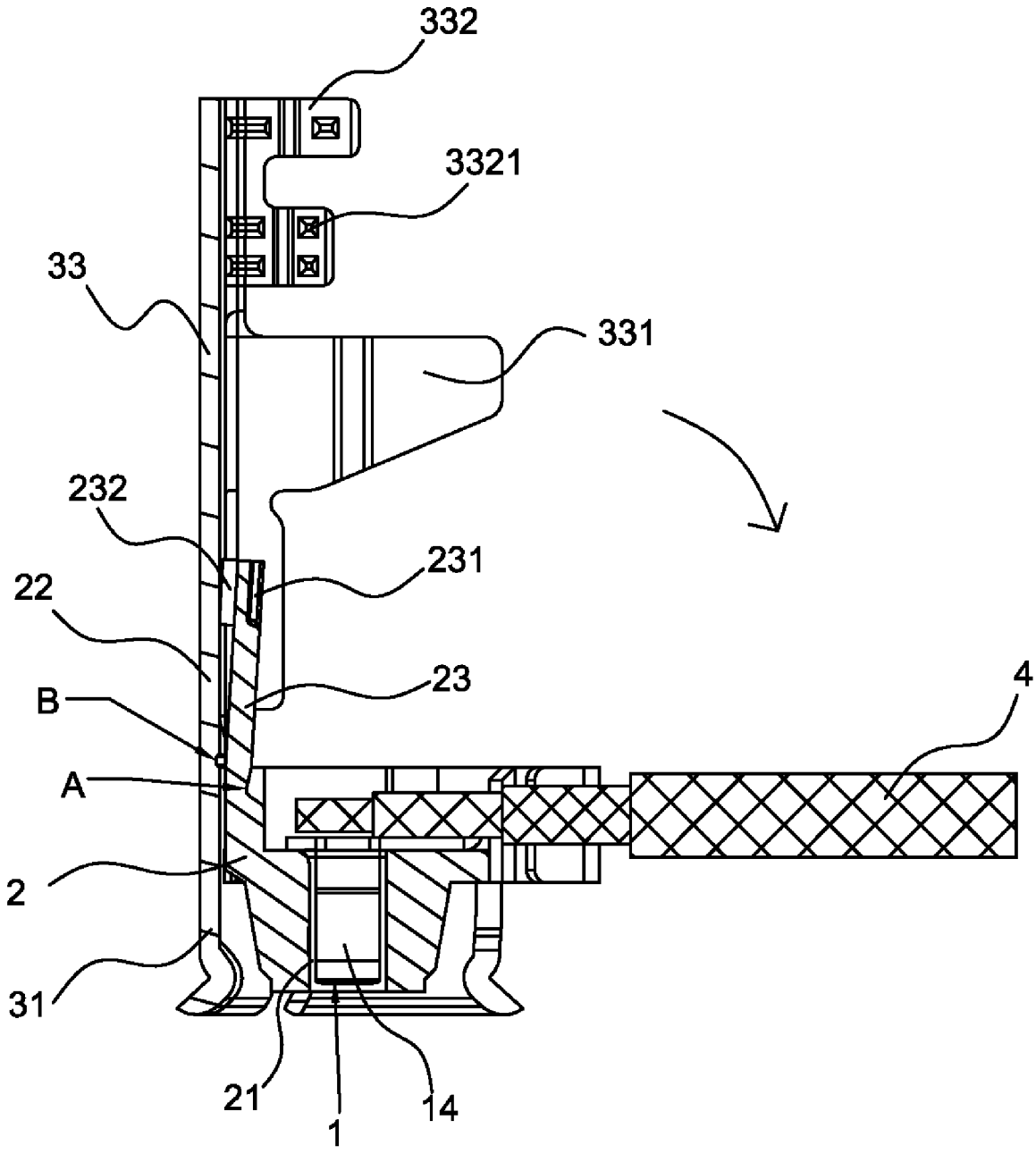
FIG. 6 is the cross-section view of the cover before bending of the metallic shell according to the present invention.
Figure 7:
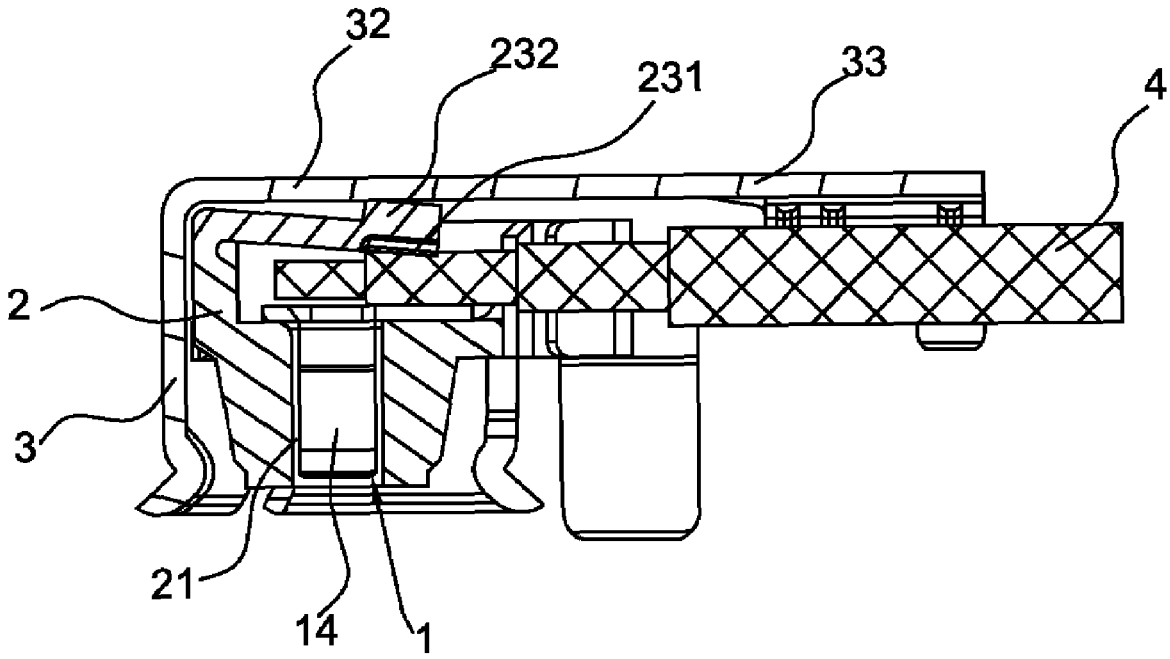
FIG. 7 is the cross-section view of the cover after bending of the metallic shell according to the present invention.

The process of assembly is as follows:

Firstly, mount the terminal member 1 in the through-hole 21, making the protrusions 12 in the terminal member enter into the concaves 24 respectively to fix the terminal member 1 closely in the insulator 2; and then insert the insulator 2 into the cylinder member 31 of the metallic shell 3, adjust the position of the insulator 2 to embed the bosses 35 into the canals 25, so the insulator 2 is combined with the cylinder member 31 closely, at this time the leading-in gap 34 in the metallic shell 3 is connected with the gap 22 of the insulator 2 and the oriented gap 11 of the terminal member 1, the outer surface of the extending member 23 in the insulator 2 is closely attached with the internal surface of the cover 32 as shown in FIG. 7. One end of the wire stock 4 is inserted into the leading-in gap 34, the gap 22 and the oriented gap 11 in sequence so the oriented gap 11 is tangent with terminal member 1 finally. As shown in FIG. 6, here comes the procession of parceling the wire stock 4: bend the extending member 23 around position A, making the wire stock 4 tangent with the groove 231 of the extending member 23; and then bend the cover 32 around position B, making the cover 32 tangent with the bulge 232 of the extending member 23 to clamp the wire further; fix the alar part 321 to the cylinder member 31; bend the first chip 331 to avoid the cylinder member 31 from shaking; finally, parcel the wire stock 4 with the second chip 332, fixing the wire stock 4 closely.

In some embodiments, the wire stock 4 can comprise an inner conductor, an inner insulator, an outer conductor and an outer insulator. Referring to FIGS. 2 and 6, the shell 3 can define a shell cavity, and a portion of the insulator 2 can be oriented within the shell cavity. The insulator 2 can also define an insulator cavity, and a portion of the terminal member 1 can be oriented within the insulator cavity. The wire stock 4 can be oriented such that the inner conductor of the wire stock 4 contacts the contact area 13 of the terminal member 1. The arm 23 of the insulator 2 can be bent to place the groove 231 in contact with the wire stock 4, and the wire stock 4 is clamped between the groove 231 and the contact area 13. In some embodiments, the groove 231 can contact the inner insulator of the wire stock 4. In some embodiments, the groove 231 can contact the inner conductor of the wire stock 4. In some embodiments, the bulge 232 is sized such that the cover 32 will apply a compressive force, causing a frictional engagement between the groove 231 and the wire stock 4. In some embodiments, the outer conductor of the wire stock 4 contacts both sides of the hook-shaped clamp 341. In some embodiments, the second chips or clamps 332 are used to secure the wire stock 4 by engaging the outer insulator.

In some embodiments, the invention comprises processes or methods of manufacturing or assembling an electrical connector as described herein.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A coaxial electrical connector comprising:

a terminal member having an oriented gap for inserting wire stock;

an insulator comprising a through-hole for mounting the terminal member and a gap inter-connected with the oriented gap of the terminal member; and a metallic shell comprising a hollow cylinder member with a leading-in gap on the side wall that is aligned with the gap of the insulator, the shell comprising a cover that can be positioned over the cylinder member;

wherein the insulator further comprises a positionable extending member having a first side and a second side, the first side comprising a groove, the groove extended inwardly from a flat surface of the first side and arranged to clamp the wire stock, wherein the second side of the extending member comprises a bulge, the bulge located opposite the groove and contacting a flat surface of the cover of the metallic shell.

2. The coaxial electrical connector according to claim 1, wherein the terminal member comprises at least one protrusion and the insulator comprises at least one recess arranged to receive the at least one protrusion.

3. The coaxial electrical connector according to claim 1, wherein the oriented gap in the terminal member is U-shaped.

4. The coaxial electrical connector according to claim 1, the insulator comprising a plurality of exterior channels, the cylinder member comprising a plurality of protrusions, wherein each protrusion is oriented in an exterior channel.

5. The coaxial electrical connector according to claim 1, wherein the cover forms a bundle portion comprising a tab having at least one boss, the tab and at least one boss arranged to grasp the wire stock.

6. The coaxial electrical connector according to claim 1, wherein the cover comprises a pair of wing-like portions arranged to clasp the cylinder member.

7. The coaxial electrical connector according to claim 1, wherein the shell comprises a hook-shaped clamp oriented about said leading-in gap.

8. The electrical connector of claim 1, wherein a central axis of the groove extends nonparallel to the portion of the shell in contact with the bulge.

9. The electrical connector of claim 1, wherein the groove is concave and extends around a portion of the wire stock.

10. An electrical connector comprising:

a shell defining a shell cavity;

an insulator oriented within the shell cavity, the insulator defining an insulator cavity, the insulator comprising a positionable arm having first and second sides, the first side of said positionable arm comprising a groove, the second side of said positionable arm comprising a bulge, the bulge located opposite the groove; and a terminal member oriented within the insulator cavity, the terminal member comprising a contact area;

wherein the positionable arm is positioned to clamp a wire stock between the groove of the positionable arm and the contact area of the terminal member, the groove is extended inwardly from a flat surface of the first side and the bulge contacts a flat surface of the shell.

11. The electrical connector of claim 10, further comprising the wire stock oriented between the groove of the positionable arm and the contact area of the terminal member.

12. The electrical connector of claim 11, wherein the insulator applies a compressive force upon the wire stock and contact area of the terminal member.

13. The electrical connector of claim 12, wherein the shell applies a compressive force upon the insulator.

14. The electrical connector of claim 11, wherein the shell comprises an entry gap, the insulator comprises an insulator gap and the terminal member comprises a terminal gap; the wire stock extending through the entry gap, insulator gap and terminal gap.

15. The electrical connector of claim 11, the wire stock comprising an inner insulator, an outer conductor and an outer insulator, wherein the outer conductor contacts a portion of the shell.

16. The electrical connector of claim 15, wherein the shell further comprises a clamp, the clamp engaging the outer insulator.

17. The electrical connector of claim 15, wherein the groove of the positionable arm contacts the inner insulator.

18. The electrical connector of claim 10, wherein a central axis of the groove extends nonparallel to the portion of the shell in contact with the bulge.

19. The electrical connector of claim 10, wherein the groove is concave and extends around a portion of the wire stock.

* * * * *